United States Patent [19]

Vermeire

[11] 4,286,780

[45] Sep. 1, 1981

[54] OPTICAL ILLUSION-PRODUCING ROTATING DEVICE

[76] Inventor: William R. Vermeire, 34 Oak Dr., Upper Saddle River, N.J. 07458

[21] Appl. No.: 10,213

[22] Filed: Feb. 8, 1979

[51] Int. Cl.[3] ..... A63J 5/00

[52] U.S. Cl. ..... 272/8 D; 273/DIG. 24; 428/8; 428/913

[58] Field of Search ..... 272/8 R, 8 D, 8 N, 8 M, 272/8 P, 8 F; 40/613, 617, 124, 124.4; 428/8, 7, 10, 913, 917, 32, 9, 542; 156/65; 46/53, 57; D33/32 G; D11/117, 119, 130, 141

[56] References Cited

U.S. PATENT DOCUMENTS

| | | | |
|---|---|---|---|
| 237,026 | 1/1881 | Knauff | 428/7 |
| 360,000 | 3/1887 | Darnall | 428/32 |
| 1,216,580 | 2/1917 | Levi | 428/7 |
| 1,976,093 | 10/1934 | Raymond | 272/8 D X |
| 2,197,615 | 4/1940 | Kelman | 428/7 X |
| 2,341,583 | 2/1944 | Tuve | 428/913 X |
| 2,414,378 | 1/1947 | Kelman | 428/7 X |
| 2,887,805 | 5/1959 | Engel | 428/7 X |
| 3,513,063 | 5/1970 | Sloane | 428/7 |
| 3,846,212 | 11/1974 | Rodermund et al. | 428/10 X |
| 3,964,189 | 6/1976 | Belokin, Jr. | 272/8 D X |

FOREIGN PATENT DOCUMENTS

| | | | |
|---|---|---|---|
| 24585 | 1/1963 | German Democratic Rep. | 428/7 |

OTHER PUBLICATIONS

Wave Apparatus, A Catalogue of Scientific Instruments by L. E. Knott Apparatus Company, Boston, Mass. © 1916, p. 108.

Wave-Motion Apparatus, Scientific Apparatus and Supplies by the Welch Scientific Company, Skokie, Ill. © 1965, p. 330.

*Primary Examiner*—Richard C. Pinkham
*Assistant Examiner*—Arnold W. Kramer
*Attorney, Agent, or Firm*—W. Patrick Quast

[57] ABSTRACT

An illusionary device comprising an elongated body of predetermined outline having at least one portion thereof twisted about the longitudinal axis of the body. This twisted portion includes a surface which is modified and adapted so as to have an appearance of an axially moving, sinusoidal, optical wave pattern if said body is rotated. This includes a plurality of axially repeating features. Any one "feature" at a given axial location along the length of the twisted portion will appear to the viewer as varying periodically from a point, to a maximum for the feature, back to a point, and so on, as the body is rotated. Also, axially successive ones of the repeating features appear to the viewer as varying from a point to a maximum and back to a point over the length of each twist. The combined effect is such that the apparent axial movement of the wave pattern is enhanced when the body is rotated. The elongated body includes a center strip having a plurality of louvered fin members extending radially outward from either side thereof so that one axially repeating feature is each of the fin members and another axially repeating feature is the space between any adjacent fin members.

18 Claims, 10 Drawing Figures

OPTICAL ILLUSION-PRODUCING ROTATING DEVICE

TECHNICAL FIELD

The present invention relates to amusement devices generally, and more particularly to an optical illusion novelty which gives the appearance of axial movement when rotated.

BACKGROUND ART

Numerous rotating illusionary devices are known. Some are educational in nature while others are for amusement.

The present invention is an amusement device which when rotated produces a beautiful and fascinating optical illusion of axial movement. When spinning, the wave portion appears to move, then vanish and reappear in midair. This illusionary movement in a described embodiment is enhanced because of the material employed in constructing the device. The device includes a basic twisted form. The illusionary effect can be modified by contouring the periphery of the form, by varying the numbers of twists, by reversing the rotational disposition of individual twists and/or groups of twists, by changing the length of various twists, and in other ways.

It is therefore a primary object of this invention to provide a rotating amusement device which produces an illusion not hitherto achievable with prior art rotating devices.

It is another object of the present invention to provide a rotating amusement device which is simple in construction and economical to manufacture.

It is still another object of this invention to provide a rotating device which in the described embodiment enhances the illusionary effect because of the constructional aspects of the device.

It is yet another object of this invention to provide a plurality of illusionary effects by modifying the basic form in various ways which are limited only by one's imagination.

DISCLOSURE OF INVENTION

In order to achieve the above objects as well as others which will become apparent from the following description and accompanying drawings, there is disclosed an illusionary device comprising an elongated body of predetermined outline having at least one portion thereof twisted about the longitudinal axis of the body. This twisted portion includes a surface which is modified and adapted so as to have an appearance of an axially moving, sinusoidal, optical wave pattern if said body is rotated. The modification includes at least one, axially repeating feature. Any one "feature" at a given axial location along the length of the twisted portion will appear to the viewer as varying periodically from a point, to a maximum for the feature, back to a point, and so on, as the body is rotated. Also, axially successive ones of the repeating feature appear to the viewer as varying from a point to a maximum and back to a point over the length of each twist. The combined effect is such that the apparent axial movement of the wave pattern is enhanced when the body is rotated.

DESCRIPTION OF THE BEST MODE

Figure 1:
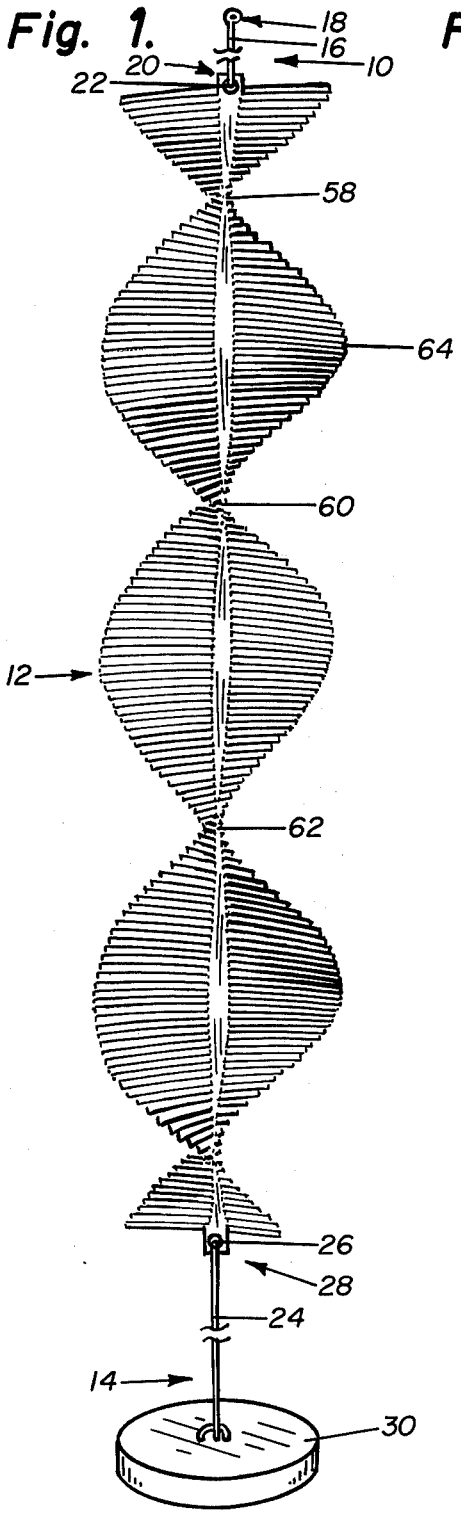
FIGS. 1 and 6 are elevational views of embodiments for the present invention depicting basic forms employed.

Referring now to FIG. 1 there is shown an embodiment of the present invention in its most basic form. A support means is shown generally at 10. Suspended therefrom is an elongated twisted body portion, 12. Means for providing sustained rotational movement while the device is being viewed are shown generally at 14.

The support means referred to above include a nylon line, 16, further including a loop, 18, which is secured to a ceiling or other support means by a push pin or the like. The other end of the nylon line, 16, is secured to the end, 20, of the twisted body by, for example, tying it to mounting hole, 22.

A second line, 24, is connected to the opening, 26, at the bottom end, 28, of the twisted body. Connected to this other line, 24, is a weight, 30, which typically is a metal, washer-like body. The line, 24, is connected to this weight, 30, by tying the former to a suitable hook or handle.

The lines, 16 and 24, as noted above, are typically nylon lines or other monofilament line much like fishing line. In fact, 4 lb. test fishing line has been found to perform well. Further, the lines typically are each approximately 20" in length.

The weight, 30, typically, would be a 2" diameter metal slug, approximately $\frac{1}{8}$" thick.

Figure 2:
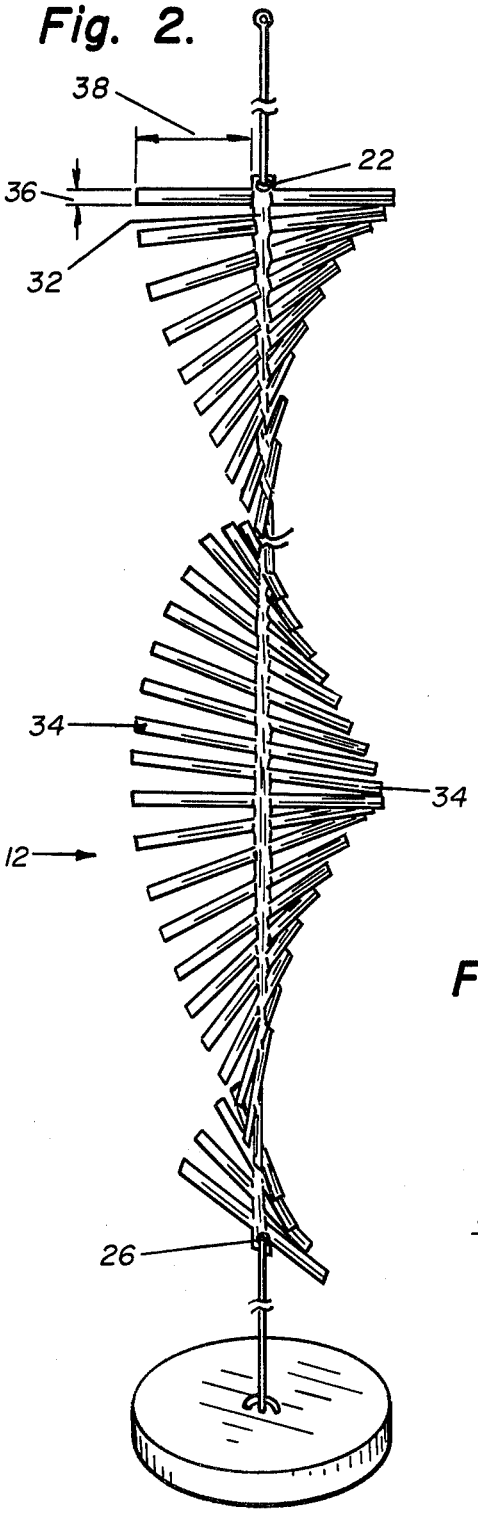
FIGS. 2 and 7 are perspective views of the forms of the invention shown in FIGS. 1 and 6, respectively, exploded along the axis to facilitate an understanding of important constructional aspects of the invention.

The details of construction with respect to the twisted body, 12, are set out in the following description with respect to FIG. 2. This latter figure as stated above is an exploded view of the version of the basic form depicted in FIG. 1.

Typically, the twisted body, 12, includes a center strip portion, 32, having the aforementioned openings, 22 and 26, at opposite ends thereof for securing the respective nylon lines thereto. In use, the center strip, 32, is coaxial with the two lines.

Extending radially outwardly from the strip, 32, are a plurality of fins such as 34. These fins are each in respective planes which are parallel to each other and at an angle with the plane containing the strip, 32. This will become more evident from the description accompanying FIGS. 3 and 4. For the embodiment shown, these fins typically are rectangularly shaped being approximately 1/16 inches (1.59 mm) in the axial dimension, 36, and approximately $\frac{7}{8}$ inches (22.23 mm) in the radial dimension, 38. Of course this is not a limitation of the present invention.

Figure 4:
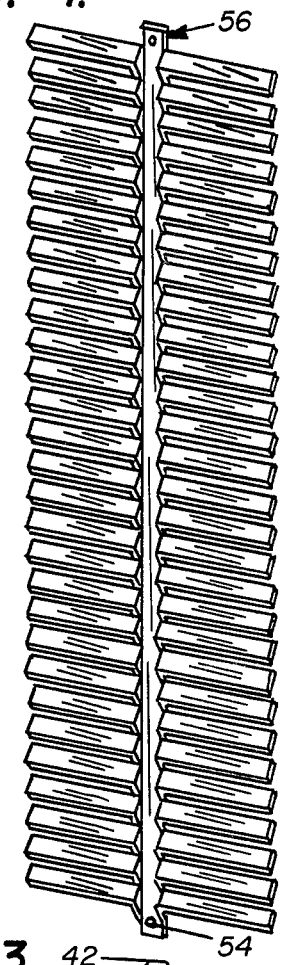
FIGS. 4 and 5 depict, at an intermediary stage, the material used in fabricating the adaptations shown in FIGS. 1 and 6.
Figure 3:
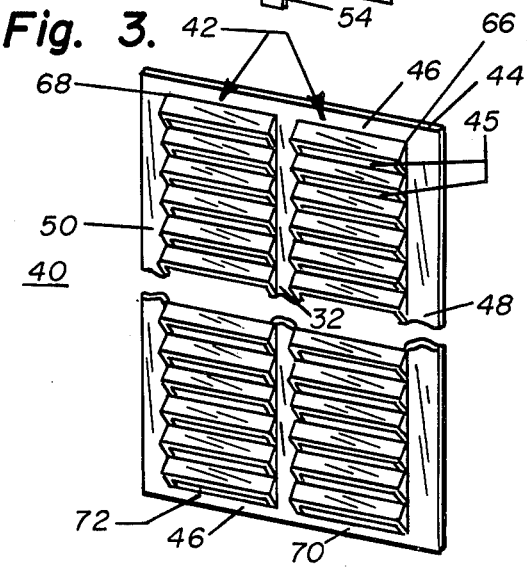
FIG. 3 is a perspective view of a starting material used in fabricating the adaptations of the invention shown in FIGS. 1 and 2.

FIGS. 3 and 4 show various stages of the basic material used to construct the embodiment described.

FIG. 3 shows a louvered material which is fabricated from a thin aluminum sheet approximately 0.008 inches (0.20 mm) thick. The louvers can be punched or pressed from the basic sheet metal stock such that the slat portions of the louver, 42, are contained in parallel planes, at the same angle to the plane of the raw stock material, 44. The formation of the louvered slats from the base material results in spaces, 45, interposed between each of the slats. A typical starting material would include two columns of such slats on either side of a center strip such as 32 above. The louvered portion of the material is bordered by sheet metal material, 46, 48 and 50. The basic starting material depicted at FIG. 3 can be purchased from the Kaiser Aluminum Company which manufactures it under U.S. Pat. Nos. 2,366,224, 2,492,909 and 2,596,997.

The material is purchased from Kaiser Aluminum Company in rolls with a plurality of louvered columns. For purposes of this invention two such columns of louvered materially are cut lengthwise along the roll and to a length of typically 20 inches (508 mm).

Figure 5:
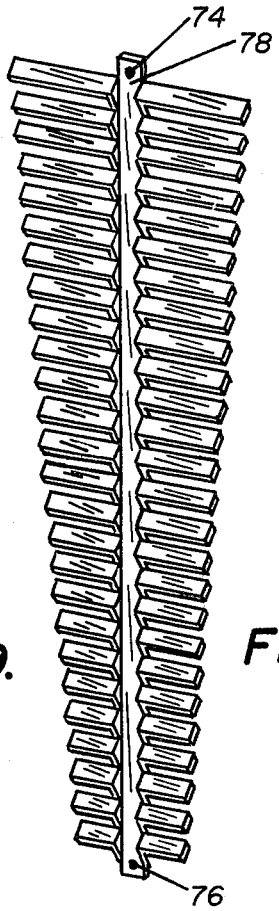
Figure 8:
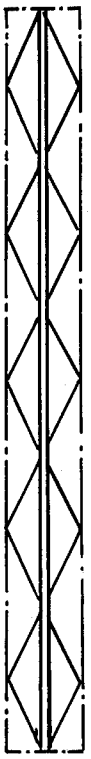
FIGS. 8, 9 and 10 are schematic views of various contours which may be cut in the basic form material, such as shown in FIG. 4, to result in different illusionary effects.
Figure 9:
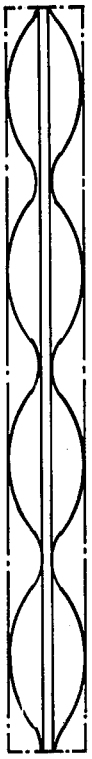
Figure 10:
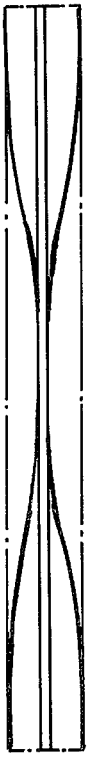

The next step in the manufacturing process is to trim off the border material, 46, 48 and 50. This may be done in a straight cut fashion as shown in FIG. 4 or, where it is desired to produce various illusionary effects, a tapered cut may be made such as shown in FIG. 5 or other peripheral shapes, such as shown at FIGS. 8, 9 and 10.

Returning to the basic form shown in FIG. 4, having trimmed the excess border material from the workpiece, the form as shown must be twisted in the desired fashion to produce the particular illusionary effect. One such effect results from the twisted shape of FIG. 1 and its exploded counterpart in FIG. 2. To produce this version, referring again to FIG. 4, one end of the body, for example the end including hole 54, is clamped in a stationary grip, while the other end, 56, is clamped to a rotating unit which can be turned at a slow rate to effect a turning of the material. The rotated clamp is turned by the operator until the elastic limit of the material used is exceeded. (Experiments with a 20" length of the material supplied by Kaiser Aluminum and manufactured under the aforementioned patents, show that this typically takes approximately 10 complete revolutions.) Once exceeded, the hysteresis tendency for the material is overcome and the body will retain a number of the twists imparted. For example, for the 20" material, where 10 revolutions were used initially, the material will lose about half of those when the clamp is released such that the net 360° twists of the body would be about 5. Assuming the elastic limit is exceeded, if the number of net twists remaining is more than desired, the number can be reduced by reversing the rotating movement.

For purposes of the illusion, by increasing the number of twists, the axial "speed" of the optical wave pattern can be altered. The fewer the number of twists the faster the apparent movement of the pattern while the greater the number, the slower the movement.

When the particular material referred to above is used, because of, at least, variations in thickness of the material, if the operator were simply to hold one end while rotating the other, the axial length of each twist would vary. To avoid this, the operator moves his hand along the length of the body as individual revolutions are made. To ensure uniformity of twist length, he will hold one twist in place if it appears it is responding too quickly (thus leading to a tight twist—too short an axial length) or otherwise manipulate the twisting procedure to ensure that the twisted portions have the desired characteristic as to axial length. Further, this simple technique of holding the body at various points along the length enables various embodiments to be fabricated. For example, twisting the body first in one direction then grasping the body at a desired point along its axis and reversing the twist, results in one very interesting version when subsequently rotated and viewed.

Also, "tightening" various twists along the length provides for interesting results. For instance, imparting relatively tight twists at one end, "loosening" up in the middle, and again "tightening" up at the other end results in a final item which likewise produces an interesting illusion when rotated.

Refer again to FIG. 1. As noted earlier, the basic material presently employed to fabricate the embodiments described so far is the louvered type material. This, of course, is not to be construed as limiting the invention to only this type material. Prior to twisting, the slat portions of the louvers are angled to the plane of the basic material and each lie in their respective plane, parallel to the others and at the same angle to the plane of the basic material. It can thus be understood, although difficult to see from the drawings, that when the material is twisted, as desribed above, the planes of the slats in the portion occurring between points 58 and 60 for example, are at one angle to the base material or vertical, which angle for illustration purposes will be said to be towards the viewer as he observes the embodiment in FIG. 1, while the angle of the slats in the adjacent portion between points 60 and 62, although at the same angle to the vertical, are in a direction away from the viewer.

With the light illuminating the device positioned at a certain location relative to the device, the angle of reflection of that light from the various finned surfaces in the portion between points 58 and 60 is different than the angle of reflection for the light incident on the finned members of the wave front between points 60 and 62. This is due, again, to the fact that the fins are angled generally towards the viewer in the former section and away, generally, from him in the second portion.

Further, within each twisted portion, because of the twist imparted to the material, pairs of the slats horizontally aligned on either side of the center strip, are disposed radially about the center strip axis in various vertical planes from a plane containing finned member 64 (a plane nearly parallel to the plane of the drawing) to a plane containing the finned members at point 60 (perpendicular to the plane of the paper), and continuing, along the length. This transition likewise causes a variation in the reflected light, further enhancing the illusionary effects achieved.

It can be understood, that as the body is caused to rotate 180°, the angle of the finned members to the vertical, for example between the points 58 and 60, will now assume the angle that had previously been associated with the finned members between points 60 and 62, i.e. the finned members may be angled towards the viewer now between 60 and 62 and away from the viewer between the points 58 and 60 so that there is an apparent axial movement of the reflecting aspects from one portion to another. This transition from one to the other is not abrupt because of the transitional effect achieved by the rotation from the plane perpendicular to the plane of the paper to a plane nearly parallel with a plane of the paper as described hereinabove. To the extent that the reflected light from two adjacent wave fronts is different so as to appear relatively dark or light as to the other, this effect reverses itself every 180° twist of the material, with the apparent suggestion to the viewer of the transition of light to dark to light, etc. along the length of the body, as it rotates.

Figure 6:
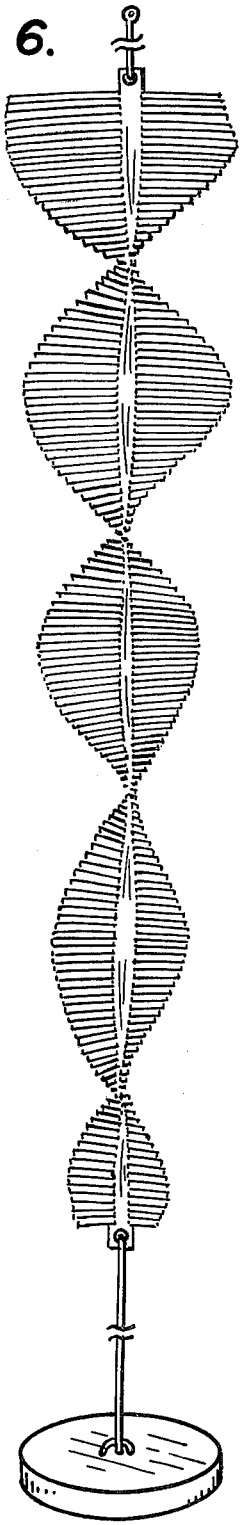
Figure 7:
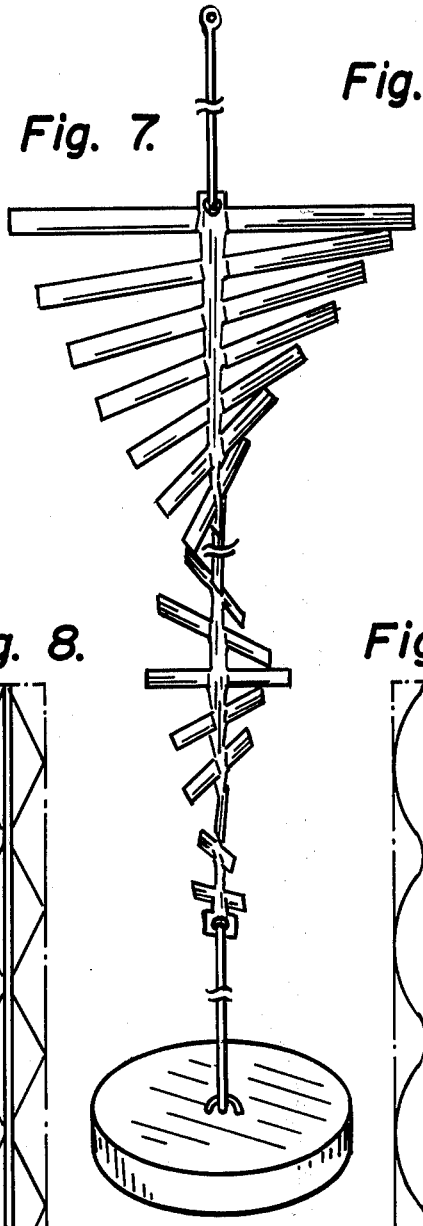

Referring now to FIG. 5, there is depicted an intermediary stage with respect to the form of the invention shown in FIGS. 6 and 7. Again, typically, the starting material might be as shown in FIG. 3. Now, however, instead of cutting the starting material along the border edges to arrive at the stage depicted at FIG. 4, a straight line cut is taken on an angle with the axis of the center strip, 32. For example, a cut from points 66 and 68 to points 70 and 72, respectively, would result in the form shown in FIG. 5. Of course, the border material, 46, where present, is again trimmed.

Holes 74 and 76 would be placed in opposite ends of the center strip, 78 in FIG. 5.

The tapered form is shown, again, to include a plurality of fins which for the material employed are disposed in planes, co-planar to themselves, but at an inclined angle to the plane of the center strip, 78.

The workpiece, as shown in FIG. 5, is then twisted in accordance with the procedure set out above to result in the final configuration, again shown in FIGS. 6 and 7.

As is the case with the embodiment depicted in FIG. 1, the utilization of finned material facilitates the twisting of the form. Also, the finned version enhances the illusionary effect by presenting reflective surfaces at varying angles with incident light, thus resulting in continuous varying angles of reflection as between the light and the viewer.

As before, the reflective variations resulting from the finned version lead to an alternating movement of "light", "dark", "light", etc. along the length of the body, which, it has been observed, enhances the illusionary effect. The reflective qualities of the various versions may be manipulated by various reflective coatings, including fluorescent paints, etc.

Also, the finned version in all of the embodiments described, or otherwise within the scope of the invention, by its nature results in an additional axially repeating feature, to wit, the spaces between axially successive ones of the fin members. This produces an airiness and breaks up possible heavy shadowing which might otherwise be present if the item were made from a solid opaque material. This additional by-product of the finned version appears to enhance the illusionary effect.

FIGS. 8, 9 and 10 suggest, schematically, but a few of the many possibilities of the present invention. Starting with the basic material of FIG. 3, for example (shown in phantom in each of these figures), the various forms depicted in solid lines can be achieved by appropriate cutting. FIG. 8 reflects a repetitive diamond pattern; FIG. 9 a series of hourglass patterns; and FIG. 10 a single hourglass pattern. It is apparent that the possibilities are practically unlimited. In addition to cutting the periphery in various ways, other fascinating illusionary effects can be achieved by reversing the twisting of the material throughout its length. For example, the bottom third of the material might be twisted clockwise; the middle third counterclockwise; and, finally, the top third again clockwise. Or, the twists within a particular portion of the form may be made "tighter" vis-a-vis twists in an adjacent portion of the form. For example, the bottom third portion of the form could be twisted in a tight manner, the middle third in a looser fashion, with the top third of the form again twisted in a tight manner. The effect of the latter described embodiment is particularly fascinating in that a viewer is left with a three-dimensional impression.

Interesting end results are also achieved for example, if the body is turned first in one direction to impart the desired number of twisted portions, then held at midpoint and the direction of rotation reversed so as to produce oppositely directed twists on the remaining portion. The end result is a wave pattern which, when the unit rotates appears to be bi-directional in movement, variations of this illusion can be created by introducing multiple reverse rotations throughout the length of the elongated body.

All of this suggests that the variations of the basic invention are limitless. The many ways that the basic forms can be configured to produce untold numbers of pleasing illusionary effects is left to the imagination of the individual.

Although the invention has been described starting with a finned, metal material, it is within the scope of the invention, certainly, if the starting material were plastic, for example having a similar configuration as described.

Further, if the material were solid, for example transparent plastic, and axially repeating features such as the fins (or even just lines) were painted or otherwise deposited thereon, the resulting product would be within the scope of the present invention.

Other variations to the above will be readily apparent to those of skill in the art. The breadth of the present invention is only to be limited by the scope of the appended claims.

What is claimed is:

1. An illusionary device comprising an elongated body of predetermined outlne having at least one portion thereof twisted about the longitudinal axis of said body, the twisted portion of the body including a surface which is modified and adapted so as to have an appearance of an axially moving, sinusoidal optical wave pattern if said body is rotated, said modification to said surface of the twisted portion including a plurality of axially repeating features, any one of said features at a given axial location appearing to the viewer, when said body is rotated, as varying periodically from a point to a maximum for that feature back to a point, etc., the axially successive ones of said features, appearing to vary from a point to a maximum back to a point over the length of said twist and wherein said elongated body includes a center strip extending the length thereof and a plurality of louvered fin members extending radially outward from either side of said center strip, and wherein one axially repeating feature is each of said fin members and wherein a second axially repeating feature comprises the spaces between axially successive ones of said fin members, said device being made of material that is sufficiently rigid such that said fin members retain their radially outward orientation and their respective axial relationship, whereby the combined visual effect is such that the axial movement of said wave pattern is enhanced when said body is rotated.

2. The device claimed in claim 1 further comprising means for rotating said body about its longitudinal axis.

3. An illusionary device comprising:

(a) an elongated body of predetermined outline having at least one portion thereof twisted about the longitudinal axis of said body, the twisted portion of the body including a surface which is modified and adapted so as to have an appearance of an axially moving, sinusoidal optical wave pattern if said body is rotated, said modification to said surface of the twisted portion including a plurality of axially repeating features, any one of said features at a given axial location appearing to the viewer, when said body is rotated, as varying periodically from a point to a maximum for that features back to a point, etc., the axially successive ones of said features, appearing to vary from a point to a maximum back to a point over the length of said twist, and wherein said elongated body includes a center strip extending the length thereof and a plurality of louvered fin members extending radially outward from either side of said center strip, and wherein one axially repeating feature is each of said fin members and wherein a second axially repeating feature comprises the spaces between axially successive ones of said fin members, said device being made of material that is sufficiently rigid such that said fin members retain their radially outward orientation and their respective axial relationship, whereby the combined visual effect is such that the axial movement of said wave pattern is enhanced when said body is rotated;

(b) means for suspending said elongated body; and (c) means for rotating said body about its longitudinal axis.

4. The device claimed in claims 2 or 3 wherein the means for rotating include a line secured to one end of said body, said means further including a disc-like weight which is spun and which, in turn, imparts rotational movement through said line to the body.

5. The device claimed in claims 1 or 3 further comprising at least a second twisted portion.

6. The device claimed in claims 1 or 3 further comprising at least a second twisted portion, wherein said two twisted portions are adjacent to each other.

7. The device claimed in claims 1 or 3 further comprising at least a second twisted portion, wherein said two twisted portions are adjacent to each other, and wherein the two twisted portions are formed by twisting the body in the same direction.

8. The device claimed in claims 1 or 3 wherein the entire elongated body has been twisted so as to substantially comprise a plurality of twisted portions.

9. The device claimed in claims 1 or 3 wherein the entire elongated body has been twisted so as to substantially comprise a plurality of twisted portions, and wherein the entire body has been twisted in the same direction.

10. The device claimed in claims 1 or 3 wherein the entire elongated body has been twisted so as to substantially comprise a plurality of twisted portions, and wherein at least one twisted portion is formed by twisting the body in one direction and where at least one other twisted portion is formed by twisting the body in the opposite direction.

11. The device claimed in claims 1 or 3 wherein the entire elongated body has been twisted so as to substantially comprise a plurality of twisted portions, and wherein the axial length of at least one twisted portion is different from the axial length of yet another twisted portion.

12. The device claimed in claims 1 or 3 wherein the entire elongated body has been twisted so as to substantially comprise a plurality of twisted portions, and wherein the axial lengths of the twisted portions consecutively along the length thereof vary from a minimum at one end to a maximum back to a minimum at the other end.

13. The device claimed in claims 1 or 3 wherein the entire elongated body has been twisted so as to substantially comprise a plurality of twisted portions, and wherein the predetermined outline from one end to the other prior to twisting is two parallel edges.

14. The device claimed in claims 1 or 3 wherein the entire elongated body has been twisted so as to substantially comprise a plurality of twisted portions, and wherein the predetermined outline prior to twisting is a taper from one end to the other.

15. The device claimed in claims 1 or 3 wherein the fin members are contained in parallel planes, said planes at substantially the same angle to the plane containing said center strip, prior to twisting.

16. The device claimed in claims 1 or 3 wherein the device is finished with at least one preselected finish.

17. The device claimed in claims 1 or 3 wherein the device is finished with at least one preselected fluorescent finish.

18. The device claimed in claims 1 or 3 wherein the device is finished with at least one preselected reflective finish.

* * * * *